United States Patent [19]

Tatsuno

[11] Patent Number: 4,553,948

[45] Date of Patent: Nov. 19, 1985

[54] OIL PRESSURE TYPE PNEUMATIC TORQUE WRENCH

[75] Inventor: Koji Tatsuno, Ando, Japan

[73] Assignee: Uryu Seisaku, Ltd., Osaka, Japan

[21] Appl. No.: 567,801

[22] Filed: Jan. 3, 1984

[30] Foreign Application Priority Data

Mar. 4, 1983 [JP] Japan ..... 58-32101[U]

[51] Int. Cl.[4] ..... B25D 15/00

[52] U.S. Cl. ..... 464/25; 173/93.5; 192/58 R

[58] Field of Search ..... 464/24, 25; 173/93, 173/93.5; 192/58 R

[56] References Cited

U.S. PATENT DOCUMENTS 3,263,426 8/1966 Skoog ..... 464/25

3,263,449 8/1966 Kramer ..... 464/25

*Primary Examiner*—Stephen Marcus

*Assistant Examiner*—Leo James Peters

*Attorney, Agent, or Firm*—Wenderoth, Lind & Ponack

[57] ABSTRACT

An oil pressure type pneumatic torque wrench which comprises a main shaft, a liner rotatable by a rotor with at least four seal points which are formed on the inner circumferential surface of the liner and two blades provided on the main shaft. The center of two opposing seal points on each of the shaft and liner are spaced equal distances from diametrical lines thereof so that each rotation of the liner produces one impulse.

1 Claim, 6 Drawing Figures

OIL PRESSURE TYPE PNEUMATIC TORQUE WRENCH

BACKGROUND OF THE INVENTION

1. Field of the Invention

This invention relates to an oil pressure type pneumatic torque wrench and has for its object to generate stabilized high torque, without raising much the oil pressure in an oil pressure type impulse torque generator, by producing one impact at each rotation of a liner with the use of two blades.

2. Prior art

Prior pneumatic torque wrenches generate impact by a mechanical method based on the turning power of a rotor and such impact is converted into the desired torque. Therefore, in this system of obtaining impacting torque by a mechanical method, as the torque of one impact is large, an irregular tightening torque is liable to take place and accordingly skill is required for tightening with uniform torque. Also, the impact noise is high, which can cause noise pollution. Also, due to noise and vibration caused by the impacts, operators are fatigued mentally and physically and there is a risk of their being attacked by Steinbrocken syndrome or by Raynaud's phenomenon. In fact, this is becoming an object of public concern.

Under the above circumstances, as a method of obtaining impulse torque, a torque wrench which prevents noise and vibration by utilizing oil pressure is considered promising. Such a torque wrench generates a constant torque and has such advantages as stabilization of tightening torque and much less noise and vibration, because of the use of oil pressure pulses instead of impacts by a mechanical method. Therefore, torque wrenches of this type are adopted widely by users. This type of torque wrench has an oil pressure impulse torque generator with a single blade or plural blades provided on a main shaft. For example, such a torque wrench with four blades is disclosed in U.S. Pat. No. 3,263,449 (Aug. 2, 1966). In the case of the former using a single blade, oil pressure of the impulse torque generator becomes higher, for which a more precise and stronger sealing construction is required. In addition, pressure is given to the blade only at one side in the circumferential direction of the main shaft and the resultant inclination of the main shaft causes such trouble as loss of output, irregularity of torque, seizing of machine parts, etc. In the case of the latter using four blades, as impulse is generated at least twice upon each rotation of the liner, the inertia of rotating mass of the liner and the liner casing is therefore less, and consequently, the impulse torque becomes lower.

SUMMARY OF THE INVENTION

The present invention has for its object to eliminate the above-mentioned disadvantages by providing a pneumatic torque wrench having two blades on a main shaft in a liner and producing a single impulse at each rotation of the liner.

BRIEF DESCRIPTION OF THE DRAWINGS

The nature and advantages of the present invention will be understood more clearly from the following description made with reference to the accompanying drawings, in which.

DETAILED DESCRIPTION OF THE PREFERRED EMBODIMENT

Figure 1:
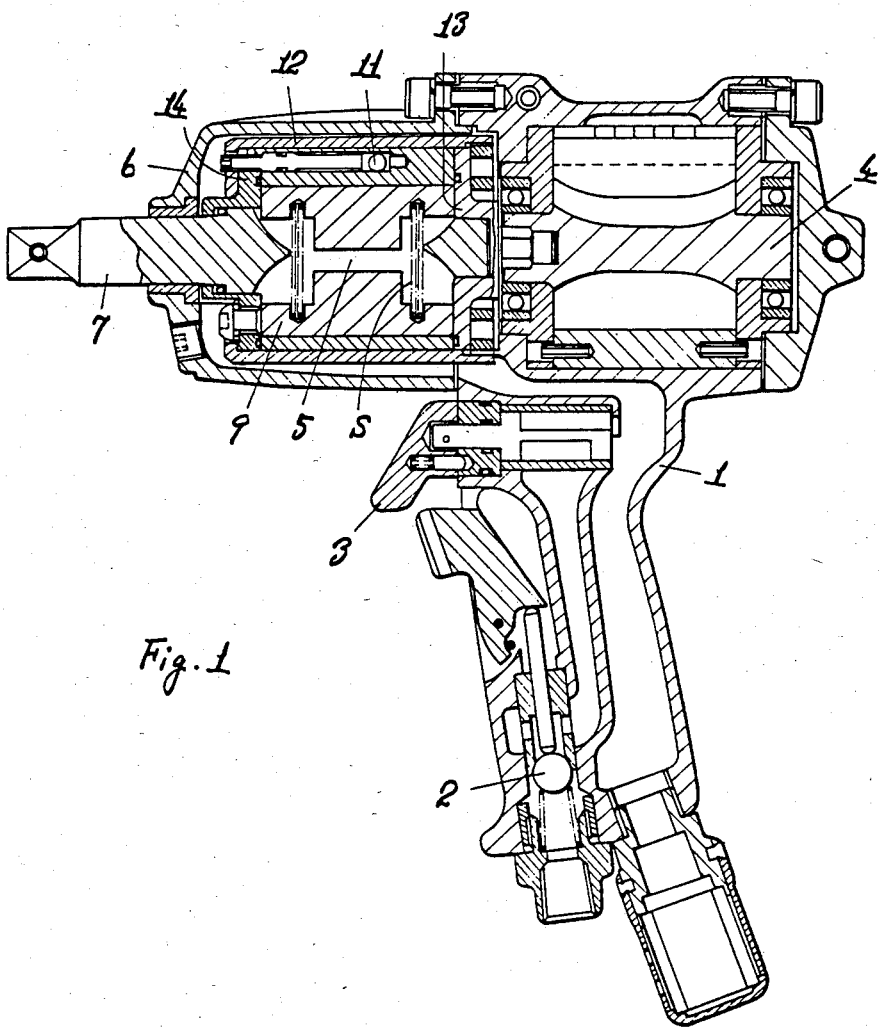
FIG. 1 is a longitudinal sectional view of one embodiment of an oil pressure type torque wrench.

In the drawings, numeral 1 denotes a main body of an oil pressure type pneumatic torque wrench, in which a main valve 2 to effect supply and stop page of supply of compressed air and a valve 3 for switching between forward and reverse turning of a rotor 4 are provided. The rotor 4 is provided in the main body 1 so that compressed air from the above valves generates rotational torque. The main body 1 has the motor construction of a general pneumatic tool.

An oil pressure type impulse torque generator 5 which converts rotational torque of the rotor 4 into impulse torque is provided in a front casing 6 which is provided protrudingly at a forward end portion of the main body 1.

Figure 3A:
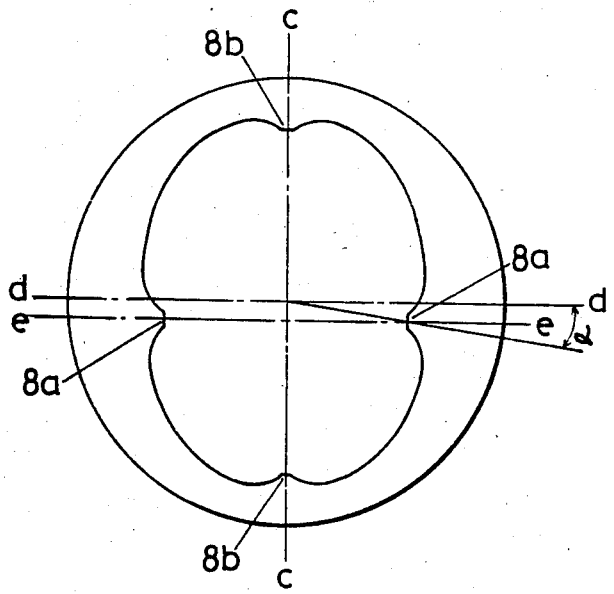
FIGS. 3A and 3B are explanatory drawings of the liner and main shaft, respectively.
Figure 3B:
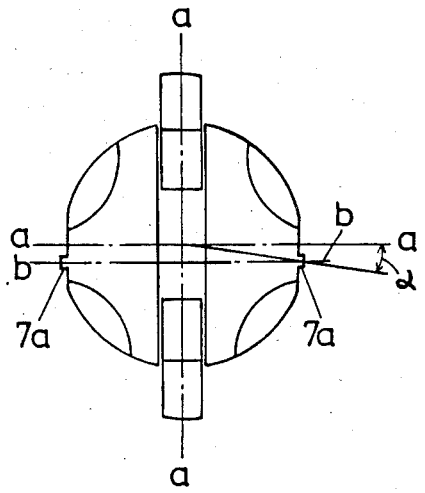

The oil pressure type impulse torque generator 5 has a liner 8 whose inner calibre is eccentric to a main shaft 7 within a liner casing 12, which liner is rotatably mounted on the main shaft 7. Working oil (pressure-transmitting fluid) for generating torque in the liner 8 fills the liner 8, which is sealed. Two opposing blade inserting grooves **7*b* are made on a diametrical line passing through the center of the main shaft 7. Inserted in the grooves 7*b* are two respective blades 9 having a thickness smaller than the width of the groove, which are biassed by a spring S to project radially outwardly toward the outer circumference of the main shaft 7. Seal points (surfaces) 7*a*, which project slightly from the outer end surface of the main shaft 7, are formed at the outer circumferential surface between the two blades 9. These seal points 7*a* are provided in such a fashion that they shift by several degrees from an axial line a—a which meets at a right angle with a straight line connecting the two grooves 7*b*. In other words, a straight line b—b connecting both seal points 7*a* as illustrated in FIG. 3B is shifted by a certain spacing from straight line a—a which is in parallel with it and passes through the center of the main shaft (an axial line which meets at right angles with a line connecting the grooves 7*b* in which blades 9 are inserted), so that a small angle 2 of several degrees may be formed between the a—a line and a straight line connecting the center of the main shaft and either seal point 7*a***.

Figure 2A:
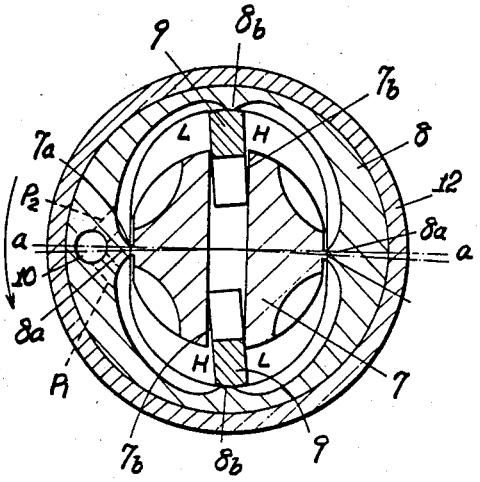
FIGS. 2A, 2B, 2C and 2D are cross-sectional views of the liner portion, showing different states in the generation of an impulse.
Figure 2B:
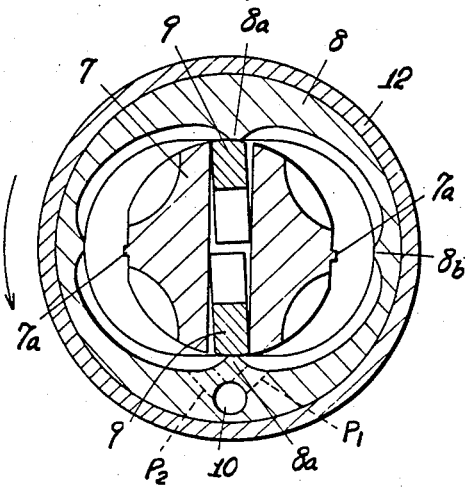
Figure 2C:
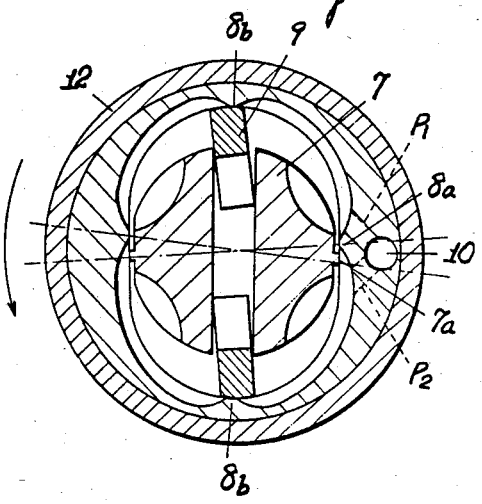

The liner 8 in which is fitted the main shaft 7 carrying the two blades 9 in such a fashion that they project in opposite directions opposite, forms liner chambers of eyebrow-shape in cross section, as shown in FIGS. 2A–2D. The liner circumferential surfaces of these opposing constricted portions are projected in cone-shapes from the inner circumferential surfaces of other portions so as to form seal points (surfaces) **8*a*. Both seal points 8*a* are formed in such a fashion that a straight line e—e connecting seal points 8*a* is shifted by a certain spacing (of a distance the same as the spacing of line b—b from line a—a) from a straight line d—d which passes through the center of the liner and is in parallel with it, so that the center of the seal point is eccentric by several degrees in one direction in relation to a diametrical straight line passing across the liner 8, as illustrated in FIGS. 2C and 3A, and also in such a fashion that when the liner 8 revolves around the outer circumferences of the main shaft inserted in the liner chamber, the seal points 8***a* make contact with or approaches the seal points 7*a* of the main shaft 7, whereby the liner chamber is divided into two, which are sealed hermetically, by the seal points 7*a* and 8*a*, as illustrated in FIG. 2A. Formed intermediately of the opposing seal points 8*a* are cone-shaped seal points (surfaces) 8*b* which divide temporarily the liner chamber into two or four chambers by contacting with an extreme ends of the blades 9. These seal points 8*b* are provided opposite to each other with their centers on a straight line passing the center of the liner chamber. An output adjusting valve inserting hole 10 is made behind one of the seal points 8*a* of the liner 8, in parallel with the center line of liner chamber, i.e., in parallel with the axis of rotation of the shaft 7. Ports $P_1$ and $P_2$ are formed at the innermost part of the hole 10 so that at least two chambers divided by the seal points 8*a* of the main shaft 7 and the two blades 9 communicate with each other. An output adjusting valve 11 is fitted adjustably in the hole 10.

In the oil pressure type torque wrench of the above construction, if the compressed air is introduced into the space containing the rotor in the main body 1 by manipulating the main valve 2 and the switch valve 3, the rotor 4 revolves at a high speed. The revolving force of the rotor is transmitted to the liner 8 aligned with the rotor axis. The liner 8 is rotatably supported at its outer circumference by the liner casing 12. An upper lid 13 and a lower lid 14 are provided at both end surfaces of the liner casing 12 so that working oil filling the liner casing 12 is hermetically sealed.

Figure 2D:
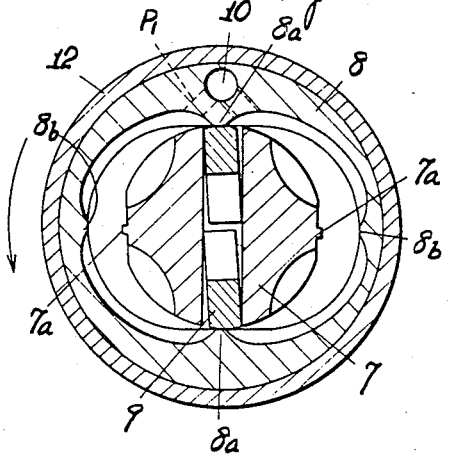

By the rotation of the liner 8, the cross-sectional shape of the liner chamber changes as shown by FIGS. 2A–2D. FIG. 2A shows the state in which impulse was generated at the main shaft 7. FIGS. 2B, 2C and 2D show respectively the state in which the liner 8 has rotated through 90 degrees from the preceding position. In FIG. 2A, the seal points 7*a* of the main shaft 1 and the blades 9 respectively contact the seal points 8*a* and 8*b* of the liner 8, the liner chamber is divided into two chambers, left and right, with the opposing blades 9 therebetween, and the left chamber and the right chamber are further divided vertically into a high pressure chamber H and a low pressure chamber L by the contacting seal points 7*a* and 8*a*. Thus, the high pressure chamber H and the low pressure chamber L are formed substantially at both sides of the blade. With the rotation of the liner 8 by the rotation of the rotor 4, of the two chambers divided by the seal points 7*a* of the main shaft 7 and the seal points 8*a* on the liner side, a high pressure chamber H decreases in volume but a low pressure chamber L increases in volume, just before the moment of impulse, and when the two chambers with blades therebetween are put in a perfectly sealed state, high pressure is generated at the high pressure chamber and such oil pressure presses momentarily the side of the blade 9 to the side of the low pressure chamber, whereupon such impulse is transmitted to the main shaft 7 in which blades are fitted and thus the desired intermittent torque is generated at the main shaft 7, which is rotated to effect the required work. After the torque is generated at the main shaft 7 by the impulse of the blade 9, further rotation of the liner 8 by 90 degrees makes the high pressure chamber H and the lower pressure chamber L communicate with each other to define one chamber. Thus, the overall liner chambers are divided only into two chambers of the same pressure and no torque is generated in the main shaft 7 but the liner rotates further by the rotation of the rotor 4. FIG. 2C shows the state in which the liner 8 has rotated further by 90 degrees, namely, rotated through 180 degrees from the time of the impulse. In this state, the opposing seal points 8*b* of the liner 8 and the seal points 7*a* of the main shaft 7 are shifted by a certain extent from the straight line a—a passing through the center and therefore a gap is caused between the seal points 7*a* and 8*a* and the liner chamber is divided into two chambers, right and left, by the main shaft 7 and upper and lower blades 9, in other words, in effectively the same state as it rotated through 90 degrees (FIG. 2B) from the time of the impulse. At this time, no change in pressure is observed throughout the whole chamber and the liner 8 rotates freely. The state in which further rotation of the liner 8 through 90 degrees or 270 degrees from the time of the impulse, is substantially the same as the state in which the liner rotated through 90 degrees. Only the position of the output regulating valve is turned upside down.

If the liner 8 turns further than the state shown by FIG. 2D, the liner chamber which was divided into two, right and left, with each blade therebetween is divided further into four, by each blade and the seal points 8*b* on the liner side and also by contact of both seal points 7*a* and 8*a* on the liner side, namely, into two high pressure chambers and two low pressure chambers with a blade therebetween. Thus, there is caused the difference in pressure between the two, whereby an impulse is generated as mentioned above and one strong impulse is generated at each rotation of the liner 8. The impulse can be adjusted by the output regulating valve 11. This adjustment can be done by the conventional method and therefore detailed explanation is omitted here.

According to the present invention, a main shaft 7 is fitted in a main body 1, at least four seal points are formed at the eye-brow shaped inner circumferential surface of the liner which is rotatable by a rotor 4, and the centers of the two opposing seal points are shifted by a certain extent from a straight line passing through the center of the overall liner chamber, whereby one impulse is generated upon each rotation of the liner 8. As the parts of both the main shaft 7 and the liner 8 are substantially symmetrical to the center line, good balance is maintained. Since the rise of internal pressure in the liner casing 12 is generated by forces from two blades, good efficiency and a strong impulse can be obtained. Thus, while in the conventional case of a single blade in which, since the torque works only on one side in circumferential direction of the shaft 7, deviation works on the ball bearings and a loss of turning power is created, in the case of the invention with two blades, there is no such disadvantage. Moreover, a good seal can be obtained and the efficiency of increasing internal pressure is improved.

In the conventional oil pressure type torque wrench, the output is low in relation to the weight, as compared with the impact wrench, and therefore a high output per weight type has been desired. The oil pressure type pneumatic torque wrench of 2 blade-1 pulse according to the present invention has the same merit as the conventional 1 blade-1 pulse type and moreover its output per weight is almost twice as high as that of the conventional type. Thus, its output in relation to its weight is close to that of the impact wrench, namely, it can eliminate the feeling of weightiness for its output. In other words, it can be made light in total weight. In addition to the above advantage, it has such advantages that its well-balanced blades improve durability and it creates less noise and less vibration.

What is claimed is:

1. An oil pressure type impulse torque generator for an oil pressure type pneumatic torque wrench, comprising:

a housing;

a generally cylindrical liner having a central axis of rotation, mounted in said housing for rotation about said axis of rotation, said liner having an inner circumferential surface having a pressure-transmitting fluid-filled, hermetically sealed cavity therein, said cavity having a generally eliptical cross section perpendicular said axis of rotation, said generally elipical cross section having a minor axis and a major axis larger than said minor axis, said minor axis and said major axis crossing each other perpendicularly on said axis of rotation at a respective mid-point of said major axis and said minor axis, said liner having first and second radially inwardly extending liner seal surfaces at respective opposite ends of said major axis and third and fourth radially inwardly extending liner seal surfaces at opposite ends of a first line parallel to and spaced a small predetermined distance from said minor axis;

a pneumatically driven rotor for rotatively driving said liner;

a main shaft having a main axis coextensive with said axis of rotation, mounted in said housing for concentric rotation in said cavity about said axis of rotation, having two slots radially extending therein in opposite directions, and first and second radially outwardly projecting shaft seal surfaces located at opposite ends of a second line extending through and perpendicular to said main axis, said second line extending parallel to and spaced a distance equal to said small predetermined distance from a third line through and parallel to said main axis, said third line extending perpendicularly to a diametrical line extending centrally through said two slots, such that said first and second shaft seal surfaces respectively frictionally engage said third and fourth liner seal surfaces only when said liner and said main shaft are in a first relative angular orientation, are spaced in the same direction from said third and fourth liner seal surfaces at a second relative angular orientation of said liner and said shaft displaced 180° from said first orientation, and be spaced from said first and second liner seal surfaces at third relative angular orientations of said liner and said shaft displaced 90° from said first orientation;

only two blades, slidably mounted in respective ones of two slots and biassed radially outwardly therein so as to frictionally engage said first and second liner seal surfaces when said liner and said main shaft are in said first relative angular orientation; and means for applying a rotative impulse force on said first and second blades through said fluid during frictional engagement of said first and second shaft seal surfaces and said first and second blades with said first, second, third and fourth liner seal surfaces, respectively, at only said first relative angular orientation of said liner and said shaft.

* * * * *